US008343336B2

(12) United States Patent
Hamad et al.

(10) Patent No.: US 8,343,336 B2
(45) Date of Patent: Jan. 1, 2013

(54) DESULFURIZATION OF WHOLE CRUDE OIL BY SOLVENT EXTRACTION AND HYDROTREATING

(75) Inventors: Esam Zaki Hamad, Dhahran (SA); Emad Naji Al-Shafei, East Province (SA); Ali Salim Al-Qahtani, Dammam (SA)

(73) Assignee: Saudi Arabian Oil Company, Dhahran (SA)

( * ) Notice: Subject to any disclaimer, the term of this patent is extended or adjusted under 35 U.S.C. 154(b) by 88 days.

(21) Appl. No.: 11/981,309

(22) Filed: Oct. 30, 2007

(65) Prior Publication Data

US 2009/0107890 A1 Apr. 30, 2009

(51) Int. Cl.
*C10G 29/20* (2006.01)

(52) U.S. Cl. ..... 208/237; 208/211; 208/236; 208/240

(58) Field of Classification Search ..... 208/236, 208/237, 238, 240, 209, 211
See application file for complete search history.

(56) References Cited

U.S. PATENT DOCUMENTS

| | | | | | |
|---|---|---|---|---|---|
| 4,124,489 | A | | 11/1978 | Reid | |
| 4,171,260 | A | * | 10/1979 | Farcasiu et al. | 208/240 |
| 4,385,984 | A | | 5/1983 | Bijwaard et al. | |
| 5,494,572 | A | | 2/1996 | Horii et al. | |
| 5,496,729 | A | * | 3/1996 | Monticello | 435/282 |
| 5,582,714 | A | * | 12/1996 | Forte | 208/237 |
| 5,753,102 | A | | 5/1998 | Funakoshi et al. | |
| 5,858,212 | A | | 1/1999 | Darcy | |
| 6,117,306 | A | | 9/2000 | Morel et al. | |
| 6,277,271 | B1 | | 8/2001 | Kocal | |
| 6,338,794 | B1 | | 1/2002 | Khare | |
| 6,531,053 | B2 | | 3/2003 | Khare | |
| 6,726,835 | B2 | | 4/2004 | Towler et al. | |
| 6,756,022 | B2 | | 6/2004 | Sakai et al. | |
| 6,929,738 | B1 | | 8/2005 | Riley et al. | |
| 6,955,753 | B1 | | 10/2005 | Gomez | |
| 7,553,406 | B2 | * | 6/2009 | Wasserscheid et al. | 208/236 |
| 2005/0067323 | A1 | | 3/2005 | Balko | |
| 2005/0230286 | A1 | | 10/2005 | Briot et al. | |

OTHER PUBLICATIONS

PCTUS0812144 International Search Report and Written Opinion, dated Jan. 16, 2009, pp. 1-7.

* cited by examiner

*Primary Examiner* — Walter D Griffin
*Assistant Examiner* — Renee E Robinson
(74) *Attorney, Agent, or Firm* — Abelman, Frayne & Schwab

(57) ABSTRACT

A high sulfur content crude oil feedstream is treated by mixing one or more selected solvents with a sulfur-containing crude oil feedstream for a predetermined period of time, allowing the mixture to separate and form a sulfur-rich solvent-containing liquid phase and a crude oil phase of substantially lowered sulfur content, withdrawing the sulfur-rich stream and regenerating the solvent, hydrotreating the remaining sulfur-rich stream to remove or substantially reduce the sulfur-containing compounds to provide a hydrotreated low sulfur content stream, and mixing the hydrotreated stream with the separated crude oil phase to thereby provide a treated crude oil product stream of substantially reduced sulfur content and without significant volume loss.

14 Claims, 2 Drawing Sheets

DESULFURIZATION OF WHOLE CRUDE OIL BY SOLVENT EXTRACTION AND HYDROTREATING

FIELD OF THE INVENTION

This invention is related to an industrial-scale process for treating whole crude oil that has a naturally high sulfur content to reduce the sulfur content.

BACKGROUND OF THE INVENTION

Sulfur-containing crude oil is referred to as "sour" and numerous processes have been described for "sweetening" the crude oil to reduce its sulfur content. Traditional hydrotreating is suitable for oil fractions, but not for whole crude oil. Treatment by separation alone leads to a loss of the crude oil volume.

There are practical methods for the desulfurization of fractions of crude oil. Various approaches have been suggested in the prior art for the desulfurization of crude oil, but there are technical difficulties and the associated costs are high. Processes for very heavy crude oils include the combination of desulfuring and cracking to produce synthetic crude.

By way of background, U.S. Pat. No. 6,955,753 discloses a process by which sulfur compounds and metals are extracted to aqueous-based solvents after a chemical reaction with an acid or a base. An emulsifier is also required to increase the contact surface area between the aqueous solvent and the oil.

In U.S. Pat. No. 5,582,714, the extraction of sulfur compounds from previously hydro-treated fractions is described. The fractions must be more volatile than the solvent in this process so that in the solvent regeneration step the sulfur compounds are vaporized, and the solvent remains a liquid. The relatively small volume of the sulfur-containing solvent stream of this process is due to the small amount of sulfur compounds in gasoline compared to the sulfur content of crude oil or heavy oil fractions. Table 1 of the patent shows that the gasoline treated 0.0464% sulfur compared to the average of 3% sulfur present in Arabian heavy crude oil.

The solvent extraction process disclosed in U.S. Pat. No. 4,385,984 is directed to reducing the polyaromatic compounds and increasing the oxidation stability of lubricating oils. Solvent recovery is not described.

A double solvent extraction process is disclosed in U.S. Pat. No. 4,124,489 for the purpose of reducing the polyaromatics content and increasing the oxidation stability of the oils. Sulfur reduction is a byproduct of the polyaromatics removal.

These processes are not suitable for, or readily adapted to the treatment of whole crude oil and other heavy fractions having a relatively high naturally-occurring sulfur content.

It is therefore one object of the present invention to provide an improved continuous process for extractive desulfurization of crude oil in which all or a substantial proportion of the solvent is recovered and recycled for use in the process.

Another object of the invention is to provide an improved continuous solvent extraction process that can be used to substantially reduce the sulfur content of crude oil and other untreated hydrocarbon streams that have a high natural sulfur content.

A further object of the invention is to provide a process for reducing the sulfur content of a crude oil feed stream that minimizes the capital requirement by utilizing existing equipment and well established procedures in one of the process steps.

Yet another object of the invention is to provide an improved solvent extraction process in which the solvent or solvents employed can be vigorously mixed with a crude oil, or a crude oil fraction, without forming an emulsion and that will provide clear liquid-liquid phase separation upon standing.

SUMMARY OF THE INVENTION

The above objects and other advantages are achieved by the improved process of the invention which broadly comprehends the mixing of one or more selected solvents with a sulfur-containing crude oil feedstream for a predetermined period of time, allowing the mixture to separate and form a sulfur-rich solvent-containing phase and a crude oil phase of substantially lowered sulfur content, withdrawing the sulfur-rich stream and regenerating the solvent, hydrotreating the remaining sulfur-rich stream to remove or substantially reduce the sulfur-containing compounds to provide a hydrotreated low sulfur content stream, and mixing the hydrotreated stream with the separated crude oil phase to thereby provide a treated crude oil product stream of substantially reduced sulfur content and without a significant loss of volume.

The preferred solvent(s) have a good capacity and selectivity for the wide range of specific sulfur compounds that are known to be present in whole crude oils from various reservoirs. A partial list of sulfur compounds commonly present in crude oils is set forth below. Crude oils from different sources typically contain different concentrations of sulfur compounds, e.g., from less than 0.1% and up to 5%. The solvents used in the process of the present invention are selected to extract aromatic sulfur compounds and thereby cover a wide range of sulfur compounds present in crude oils. The preferred solvents will also extract some aliphatic sulfur compounds. The aliphatic sulfur compounds are usually present in crude oils at low concentrations and are easy to remove by conventional hydrodesulfurization processes.

Examples of classes of aliphatic sulfur compounds in crude oils include:

R—S—R, R—S—S—R and H—S—R, where R represents alkyl groups of $CH_3$ and higher.

Some specific compounds include:

2,4-DMBT; 2,3-DMBT; 2,5,7-TMBT; 2,3,4-TMBT; 2,3,6-TMBT; DBT; 4-MDBT; 3-MDBT; 1-MDBT; 4-ET-DBT; 4,6-DMDBT; 2,4-DMDBT; 3,6-DMDBT; 2,8-DMDBT; 1,4-DMDBT; 1,3-DMDBT; 2,3-DMDBT; 4-PRDBT; 2-PRDBT; 1,2-DMDBT; 2,4,7-TMDBT; 4-BUTDBT; 2-BUTDBT; 4-PENDBT; and 2-PENDBT, in the prefixes, where, in the prefixes, D=di, ET=ethyl, T=Tri, M methyl, PR=propyl, BUT=butyl and PEN=pentyl (1)

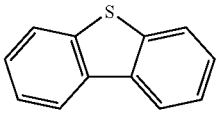

DBT: Dibenzothiophene (2)

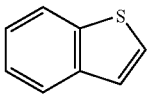

BT: Benzothiopene

-continued (3)

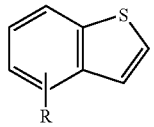

Single substitution of BT (4)

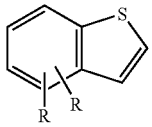

Double substitution of BT (5)

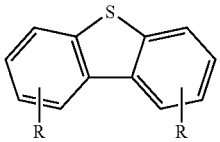

Double substitution of DBT

It is equally important that the emulsion formed after mixing the solvent(s) and crude oil, or fractions, will break easily and allow prompt phase separation in order to process the extract and raffinate streams. The proper selection of the solvent(s) will eliminate or linimize the need for additional chemical treatment to reduce or break the emulsion.

Most solvents will become saturated after exposure to the solute and the sulfur compounds removed by the solvent will reach an equilibrium state, after which no additional sulfur can be removed. However, in the process of the present invention, the saturated solution is transferred to the solvent regeneration unit to remove the sulfur compounds and is returned for reuse of the solvent(s). A suitable type of regeneration unit is an atmospheric distillation column, the method of operation of which is well known in the art.

It is to be understood that, for convenience, the process of the invention will be described in the specification and claims with reference to the extractive solvent not being miscible with the oil. Although complete immiscibility is highly desirable, as a practical matter some mixing will occur in the oil/solvent system. However, it is important that the solvent have as low a miscibility as possible with the oil being treated. If the solvent(s) that are preferred for use in the process, e.g., based on availability, have a higher miscibility than can be accepted in downstream processes, a solvent stripping unit can be provided to reduce any remaining solvent to an acceptable level.

As used herein, it will also be understood that the term "crude oil" is intended to include whole crude oil, crude oil that has undergone some pre-treatment, and crude oil fractions that have a high sulfur content. The term crude oil will also be understood to include oil from the well head that has been subjected to water-oil separation; and/or gas-oil separation; and/or desalting; and/or stabilization.

BRIEF DESCRIPTION OF THE DRAWINGS

The invention will be further described below and with reference to the attached drawings in which.

DETAILED DESCRIPTION OF THE PREFERRED EMBODIMENTS

Figure 1:
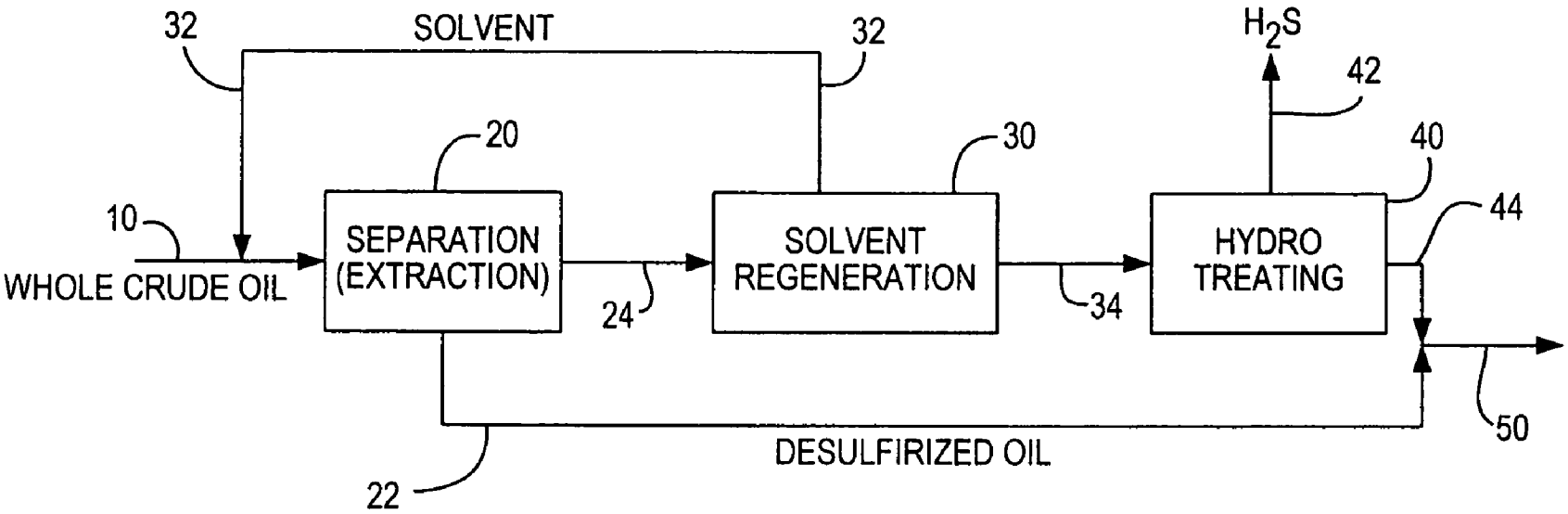
FIG. 1 is schematic illustration of one embodiment of the process of the present invention.

The process of the present invention will be further described with reference to the embodiment of FIG. 1 in which a feedstream of high-sulfur content whole crude oil (10) is introduced into an extraction/separation unit (20) where it is mixed with one or more solvents (32) that convert the sulfur-containing compounds in the crude oil feedstream (10) into a solvent-soluble compound that is concentrated in the solvent phase. As previously noted, the solvent is not miscible with the whole crude oil.

Following the liquid-liquid phase separation, the desulfurized or sweetened portion (22) of the whole crude oil stream is removed from the extraction/separation unit (20) and transferred for further downstream processing (not shown) as an enhanced product. The sulfur-rich sour stream (24) is removed from the extraction unit (20) and fed to a solvent recovery unit (30). The solvent is stripped out and recovered as stream (32) and returned for introduction with the whole crude oil feedstream into the extraction/separation unit (20).

After the solvent has been stripped, the remaining sulfur-rich whole crude oil stream (34) is then fed to a hydrotreating unit (40). Hydrogen sulfide stream (42) is withdrawn for subsequent treatment or use, and the sweetened whole crude oil (44) is removed for further downstream processing. In a preferred embodiment, the treated streams (22, 44) are combined to form a sweetened stream (50).

As will be understood by one of the ordinary skill in the art, the cost of a hydrotreating unit is proportional to the volumetric flow rate of the feedstream that is to be treated and, within limits, is not sensitive to the sulfur content of the feed. For example, a 50-100% increase in sulfur content will only lead to a small increase in the operating cost, however a large increase in the flow rate (e.g., a few percent) will lead to an appreciable increase in operating cost. Since the capital construction cost of a separation unit is much less than the cost of a hydrotreating unit, the particular combination of preliminary extraction and separation followed by hydrotreatment of a much smaller volume in accordance with the method of the invention results in substantial capital cost savings and operational economies, and the ability to utilize existing and technically mature units. The process of the invention is rendered even more attractive as the demand for sweetened crude oil increases and the market price differential between sweet and sour whole crude oil increases.

An important factor in the efficient operation of the process is the proper selection of the solvent, or solvents, used in the separation unit. Suitable solvents include the following:

1. Compounds containing the furan ring $C_4H_4O^-$. Useful compounds include furfural, furfuryl alcohol, 2-furyl methyl ketone and 5-methylfurfural. Furan itself does not form the necessary liquid phase with crude oil or most of its fractions, and it is therefore not a candidate for use in the present process. Satisfactory results in processing diesel oil were achieved with furfural.
2. Compounds containing cyclic carbonate constituents, such as propylene carbonate and ethylene carbonate.
3. Compounds containing the nitrile group, including acetonitrile, which form no persistent emulsion with the crude oil.
4. Ketones, including acetone and diacetyl, which are easily separated from the oil.
5. Mixtures of the above solvent compounds with each other and/or with small amounts of water and/or alcohol.

From the above description of the process of the invention, the selection and identification of additional useful solvents is readily within the ordinary skill of the art. The determination of miscibility with the crude oil, or other heavy oil fraction is made by mixing and observing the mixture after standing.

Figure 2:
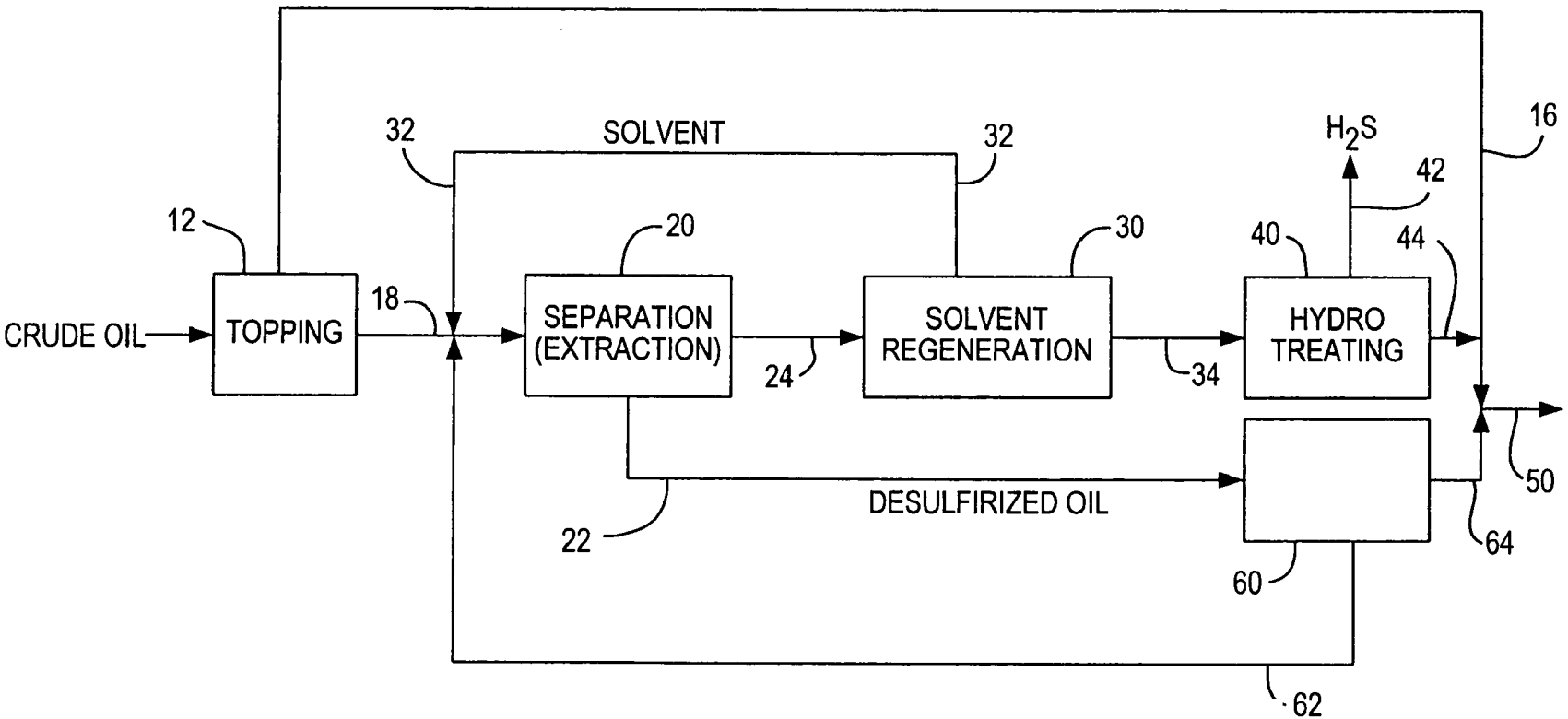
FIG. 2 is a schematic illustration of a second embodiment of the invention which includes the further step of topping the crude oil.

Referring now to FIG. 2, there is shown a second embodiment of the invention which schematically illustrates the additional step of topping the crude oil before it is introduced into the extraction unit with the solvent stream. The high sulfur content crude oil stream (10) is introduced into topping unit (12) where it is subjected to distillation in an atmospheric distillation column to remove the lighter fractions of the crude oil. Lighter fractions are those with a boiling point less than, or equal to Tmax, where 80° C.<Tmax<260° C.

Alternatively, the crude oil stream (10) can be subjected to flash separation in a flash drum to remove the lighter fractions of the crude oil. The top stream (16) consists of the lighter fractions and is referred to as the "Tmax minus" stream because it boils below Tmax. Stream (16) from topping unit (12) is substantially free of sulfur and is removed for further downstream processing. The crude oil bottoms (18) from the topping unit (12) have a relatively higher concentration of sulfur and are introduced with solvent stream (32) into the extraction/separation unit (30) where they are vigorously mixed.

Thereafter, the process is conducted as described in detail above in connection with FIG. 1. Reduced sulfur top stream (16) can be mixed downstream with the desulfurized crude (22), or optionally solvent-stripped stream (64), and the hydrotreated stream (44) to provide a final product stream (52) of substantially lowered sulfur content, as compared to the incoming crude oil stream (10).

As was noted above, the solvent selected may be miscible in the desulfurized oil stream (22) to an extent that is undesirable. As shown in FIG. 2, a solvent stripping unit (60) is provided to reduce or remove solvent remaining in stream (62) and produce solvent-stripped stream (64) that is mixed with the other treated streams (16, 44) to provide the final product stream (52).

It will be understood from the above description, that the sulfur-rich stream (34) is of a relatively small volume as compared to the entering crude oil stream (10). Thus, the hydrotreating unit need only process this relatively small volume, thereby substantially reducing capital and operating costs of the desulfurizing step as compared to the approach of the prior art.

Operating costs are further minimized by recovering all or substantially all of the solvent mixed with the crude and recycling it for reuse in the solvent extraction step of the process. The volumetric ratio of solvent to crude oil is preferably controlled to maximize the amount of the sulfur compounds dissolved as the solute. The quantity and types of sulfur compounds present in the crude oil feedstream (10) is readily determined by conventional qualitative and quantitative analytical means well known to the art. The saturation levels of the sulfur compounds in the one or more solvents employed is determined either from reference materials or by routine laboratory tests.

In the practice of the process, the flow rate of the crude oil, or the solvent(s), or both, are controlled in order to maximize desulfurization in the extraction step. The process may also require periodic testing of the crude oil feedstream (10) to identify any variation in sulfur compound content and/or concentration with an appropriate modification of the process parameters.

Hindered sulfur compounds such as 4,6-DMDBT are about 100 times less reactive than DBT in typical hydrodesulfurization processes. In the extraction unit used in the process of this invention, the hindered compounds are only slightly more difficult to extract, e.g., from 1.3 to 2 times.

Molecular modeling can also be utilized to optimize the specific solvent(s) selected for a given crude oil feedstream. Molecular modeling is based on a combination of quantum mechanical and statistical thermodynamic calculations. It is used to estimate the solubility of the different sulfur compounds in various solvents. This method is also useful in estimating the selectivity of various solvents for sulfur compounds from mixtures containing hydrocarbons and sulfur compounds, such as crude oil and its fractions.

As will be apparent from the above description of the process of the invention, solvents that form stable emulsions with crude oil should not be used. However, the process can also be modified to include the addition of one or more emulsion-breaking compounds, if necessary. The use of chemical emulsion-breaking compounds and compositions is well known in the art.

In the description of the invention schematically illustrated in the drawings and in the following examples, the embodiment relates to batch processing of the sulfur-containing feedstream. As will be understood by one of ordinary skill in the art, continuous extraction processes can be applied in the practice of the invention. Extraction columns can be used with the oil and solvent flowing in countercurrent or concurrent relation with the mixing achieved by the column's internal construction. Apparatus that can be used include static columns such as sieve trays, random packing, structured packing (SMVP); and agitated columns such as the Karr column, Scheibel column, rotating disc contractor (RDC) and pulsed column.

The following examples identify a variety of solvents and their relative capacity to dissolve sulfur compounds found in different grades of crude oil and crude oil fractions to thereby sweeten the crude oil. In these examples, total sulfur content was determined by analysis, but not the amount of the individual sulfur compounds.

EXAMPLE 1

A separatory funnel was charged with untreated diesel fuel which contained 7547 ppm sulfur. An equal volume of furfural was added as the extraction solvent. After shaking for 30 minutes, the mixture was left to stand to allow the separation of the two liquid phases. This procedure was repeated two more times. The treated diesel was collected and analyzed for sulfur content using an ANTEK 9000 instrument. A 71% reduction in sulfur was found, the treated diesel having 2180 ppm sulfur.

EXAMPLE 2

Example 1 was repeated, except that propylene carbonate was employed as the solvent, and that the extraction was repeated three times. A 49% reduction in sulfur was observed.

EXAMPLE 3

Example 1 was repeated, except that acetonitrile was employed as the solvent. A 37% reduction in sulfur was observed.

EXAMPLE 4

A separatory funnel was charged with acetonitrile as the $10^x$ extraction solvent and Arab heavy crude oil with 2.7%, or 27,000 ppm, of sulfur in a volume proportion of 1:1; after shaking for 30 minutes, it was left to stand to allow the formation of two phases. The oil phase was collected. The sulfur content of the product before and after extraction was determined by x-ray fluorescene (XRF). The sulfur reduction was 1,105 ppm, or about a 5% reduction.

EXAMPLE 5

Two organic solvents, γ(butylimino)diethanol and dimethylformamide, were selected to remove organic sulfur from straight run diesel. Ten ml of diesel containing 7760 ppm sulfur was separately mixed with 20 ml of γ(butylimino) diethanol and dimethylformamide, respectively. The mixture was agitated in a shaker, (model KIKA HS501) stirred for 2 hours at a speed of 200 rpm at room temperature. The two liquid phases were decanted. The sulfur content of straight run diesel was reduced and the sulfur content of diesel after extraction was 4230 ppm for γ(butylimino)diethanol and 3586 ppm for dimethylformamide. The total organic sulfur removed from the diesel was about 48% and 53%, respectively.

EXAMPLE 6

Diacetyl was used to extract sulfur compounds from three types of crude oils having different densities. The ratio of solvent-to-oil was 3:1. Table 1 shows sulfur concentrations and densities of the three oils.

TABLE 1

Properties of tested oil

| Oil Type | total sulfur, ppm | Density, g/cm$^3$ |
|---|---|---|
| Arabian light crude oil | 18600 | 0.8589 |
| Arabian medium crude oil | 25200 | 0.8721 |
| Arabian heavy crude oil | 30000 | 0.8917 |

Mixtures of each oil with diacetyl were stirred for 30 minutes at 100 rpm at room temperature. The sulfur removed from the oil was about 35% for the Arabian light crude. 26% for the Arabian medium and 21% for the Arabian heavy crude oil. Table 2 shows the sulfur concentrations in the extract of each oil.

TABLE 2

Sulfur content of raffinate and extract

| Oil Type | Sulfur in extract (removed from oil), % |
|---|---|
| Arabian light crude oil | 35.1 |
| Arabian medium crude oil | 26.2 |
| Arabian heavy crude oil | 21.1 |

The process of the invention is not limited for use with crude oil, but can also be applied to crude oil fractions, such as diesel.

EXAMPLE 7

Extraction of sulfur compounds from straight run diesel was conducted at three different ratios of diacetyl-to-diesel. The concentration of sulfur in the diesel was 7600 ppm. The mixing period was 10 minutes at room temperature. The concentration of sulfur in the extract and raffinate was measured by XRF. The results are summarized in Table 3.

TABLE 3

Extraction of straight run diesel using diacetyl

| Batch extraction ratios | Sulfur in Extract (removed from diesel) % |
|---|---|
| 1:1 | 35.5 |
| 2:1 | 54.7 |
| 3:1 | 73.0 |

The sulfur content in diesel is lower than crude oil. Therefore, the percentage extracted by a selected solvent is greater for the diesel compared to the crude oil. The capacity of the solvents, i.e., saturation by sulfur compounds is essentially fixed. Thus, even though the amount of extracted sulfur is almost the same, in relative value it will be larger when there is initially a low sulfur concentration, as is the case with diesel.

EXAMPLE 8

Extraction of sulfur compounds from straight run diesel was conducted using propylene carbonate. The straight run diesel had a sulfur concentration of 7600 ppm. The extraction at three different ratios of solvent-to-diesel were performed at room temperature and a mixing time of 10 minutes. The sulfur concentration of extract and raffinate were measured by XRF. The results are summarized in Table 4.

TABLE 4

Extraction of straight run diesel using propylene carbonate

| Batch extraction ratios | Sulfur in Extract (removed from diesel) % |
|---|---|
| 1:1 | 18.7 |
| 2:1 | 30.4 |
| 3:1 | 37.5 |

EXAMPLE 9

Diethylene glycol monoethyl ether was used to extract sulfur compounds from straight run diesel. The straight run diesel had a sulfur content of 7600 ppm. The extraction was performed for three different ratios of solvent to diesel at room temperature and a mixing time of 10 minutes. The sulfur concentration of extract and raffinate were measured by XRF. The results are summarized in Table 5.

TABLE 5

Extraction of straight run diesel using diethylene glycol monoethyl ether

| Batch extraction ratios | Sulfur in Extract (removed from diesel) % |
|---|---|
| 1:1 | 21.244 |
| 2:1 | 34.357 |
| 3:1 | 42.714 |

EXAMPLE 10

Methanol was used to extract sulfur compounds from straight run diesel having a sulfur content of 7600 ppm. The extraction at three different ratios of solvent to diesel was performed at room temperature and a mixing time of 10 minutes. The sulfur concentration of extract and raffinate were measured by XRF. The results are summarized in Table 6.

TABLE 6

| Extraction of straight run diesel using methanol | |
|---|---|
| Batch extraction ratios | Sulfur in Extract (removed from diesel) % |
| 1:1 | 10.300 |
| 2:1 | 23.495 |
| 3:1 | 33.333 |

EXAMPLE 11

Acetone was used to extract sulfur compounds from straight run diesel having a sulfur concentration of 7600 ppm. The extraction at three different ratios of solvent-to-diesel was performed at −5° C. and mixing time of 10 minutes. The sulfur concentration of extract and raffinate were measured by XRF. The results are summarized in Table 7.

TABLE 7

| Extraction of straight run diesel using acetone | |
|---|---|
| Batch extraction ratios | Sulfur in Extract (removed from diesel) % |
| 1:1 | 45.659 |
| 2:1 | 69.798 |
| 3:1 | 77.549 |

EXAMPLE 12

Furfural was used to extract sulfur compounds from a model diesel having a sulfur content of 4800 ppm. The model diesel was prepared by mixing 70% n-dodecane and the following aromatic compounds: 15% toluene and 10% naphthalene and 5% dibenzothiophene. The extraction with four different ratios of solvent-to-diesel was performed at room temperature and with a mixing time of 2 hours. The results are summarized in Table 8.

TABLE 8

| Extraction of model diesel (4800 ppm sulfur) using furfural | | |
|---|---|---|
| Batch extraction ratios Solvent to diesel ratio | Sulfur in model diesel after extraction, ppm | Sulfur removed from model diesel, % |
| ½:1 | 2100.7 | 56.2 |
| 1:1 | 1249.8 | 74.0 |
| 2:1 | 710.5 | 85.2 |
| 3:1 | 525.7 | 89.0 |

EXAMPLE 13

Example 8 was repeated with a model diesel containing 9200 ppm sulfur. The results are summarized in Table 9.

TABLE 9

| Extraction of model diesel (4800 ppm sulfur) using furfural | | |
|---|---|---|
| Batch extraction ratios Solvent to diesel ratio | Sulfur in model diesel after extraction, ppm | Sulfur removed from model diesel, % |
| ½:1 | 4097 | 55.5 |
| 1:1 | 2456.3 | 73.3 |
| 2:1 | 1389.9 | 84.9 |
| 3:1 | 900.9 | 90.2 |

EXAMPLE 14

Acetone was used to extract sulfur compounds from Arabian light crude oil containing 18600 ppm sulfur. The extraction of three different ratios of solvent-to-crude oil was performed at room temperature and the mixing time was 10 minutes. The sulfur concentration of extract and raffinate were measured by XRF. The results are summarized in Table 10.

TABLE 10

| Extraction of Arabian light crude oil using acetone | |
|---|---|
| Batch extraction ratios | Sulfur in Extract (removed from oil) % |
| 1:1 | 61.092 |
| 2:1 | 65.075 |

EXAMPLE 15

Acetone was used to extract sulfur compounds from Arabian medium crude oil which contained 25200 ppm sulfur. The extraction at three different ratios of solvent-to-crude oil was performed at room temperature and the mixing time was 10 minutes. The sulfur concentration of extract and raffinate were measured by XRF. The results are summarized in Table 11.

TABLE 11

| Extraction of Arabian medium crude oil using acetone | |
|---|---|
| Batch extraction ratios | Sulfur in Extract (removed from oil) % |
| 1:1 | 42.645 |
| 2:1 | 45.575 |
| 3:1 | 45.922 |

EXAMPLE 16

Acetone was used to extract sulfur compounds from Arabian heavy crude oil which contained 30000 ppm sulfur. The batch extraction of four different ratios of solvent-to-crude oil were performed at room temperature and the mixing time was 10 minutes. The sulfur concentration of extract and raffinate were measured by XRF. The results are summarized in Table 12.

TABLE 12

| Extraction of Arabian Heavy crude oil using acetone | |
|---|---|
| Batch extraction ratios | Sulfur in Extract (removed from oil) % |
| 1:1 | 22.792 |
| 2:1 | 29.901 |
| 3:1 | 35.394 |
| 4:1 | 39.209 |

EXAMPLE 17

Acetone solvent was employed to extract organic sulfur from six petroleum cuts. The batch extraction ratio of 1:1 was applied for each petroleum cut with acetone solvent. Table 13 illustrates the sulfur concentration of the petroleum cuts. The batch extractions of six petroleum cuts were performed at room temperature and the mixing time was 10 minutes. The sulfur concentration of extract and raffinate was measured by XRF. The results are summarized in Table 13.

TABLE 13

| Extraction of petroleum cuts using acetone | | |
|---|---|---|
| Batch extraction ratios | Sulfur of petroleum cuts In-feed, ppm | Sulfur in Extract (removed from oil), % |
| Cut-4, 315-400° F. | 1200 | 78.927 |
| Cut-5, 400-500° F. | 4720 | 42.787 |
| Cut-6, 500-600° F. | 14840 | 40.418 |
| Cut-7, 600-700° F. | 25080 | 43.208 |
| Cut-8, 700-800° F. | 26840 | 27.193 |
| Cut-9, 800-900° F. | 30330 | 19.599 |

These examples illustrate the extraction of sulfur compounds from Petroleum Cut-4 through Petroleum Cut-9.

As previously noted, the capacity of the solvents up to their saturation point with extracted sulfur compounds is substantially fixed and the amount of the sulfur compounds that can be extracted is approximately the same; however, the relative value will be larger when the initial sulfur content is low.

Solvent recovery was conducted on the acetone extract using a rotary evaporator and almost 100% of the acetone used in the extraction step was collected and found to be suitable for reuse in the extraction step.

As demonstrated by the above laboratory examples, the method of the invention is capable of substantially reducing the sulfur content of a variety of feedsteams, and various solvents and solvent types can be used. Many suitable solvents are available in petrochemical refineries and economies can be realized by selecting a solvent that is being produced on the site, or nearby, that can be delivered by pipeline.

While the process of the invention has been described in detail and its practice illustrated by the above examples, variations and modifications are within the ordinary skill of the art and the scope of the invention is to be determined by the claims that follow.

We claim:

1. A solvent extraction process for the desulfurization of a whole crude oil feedstream that includes one or more aromatic sulfur-containing hydrocarbon compounds, the process comprising:

a. mixing the whole crude oil with a solvent feedstream containing one or more extractive solvents for the one or more aromatic sulfur-containing hydrocarbon compounds;

b. separating as a first phase whole crude oil having a reduced content of aromatic sulfur-containing hydrocarbon compounds and as a second phase the one or more solvents and dissolved aromatic sulfur-containing hydrocarbon compounds from the whole crude oil;

c. recovering the first phase for further processing;

d. subjecting the second phase to a solvent regeneration step to recover a solvent for use in step (a), above;

e. recovering aromatic sulfur-containing hydrocarbon compounds;

f. subjecting the recovered aromatic sulfur-containing hydrocarbon compounds to hydroprocessing; and g. recovering a second liquid hydrocarbon stream having a reduced content of aromatic sulfur-containing hydrocarbon compounds from the hydroprocessor.

2. The process of claim 1 where the one or more solvents are selected from the group consisting of solvent compounds containing the furan ring, compounds containing the cyclic carbonate constituent and compounds containing the nitrile group, ketones, and mixtures thereof.

3. The process of claim 1 in which the one or more solvents are selected from the group consisting of furfural, dimethyl formamide, propylene carbonate, ethylene carbonate, acetone, acetonitrile, diacetyl, diethylene glycol, methanol, and γ(butylimino)diethanol.

4. The process of claim 1 in which the whole crude oil is selected from the group consisting of heavy, medium and light crude oils, and mixtures thereof.

5. The process of claim 1 which includes the steps of:

h. analyzing the whole crude oil feedstream to identify the sulfur compounds present; and i. selecting the one or more extractive solvents based upon their relative ability to form a solute with one or more of the sulfur compounds in the whole crude oil.

6. The process of claim 1 in which the extractive solvent is introduced into the whole crude oil feedstream prior to its introduction into a mixing vessel.

7. The process of claim 1 in which the ratio of solvent to whole crude oil during mixing is in the range of from 0.5:1 to 3:1.

8. The process of claim 1 which includes adding an emulsion breaking composition to the mixture of solvent and whole crude oil to promote the formation of two liquid phases.

9. The process of claim 1 which includes the step of pretreating the whole crude oil by one or more processes selected from the group consisting of oil-water separation, gas-oil separation, desalting and stabilization.

10. The process of claim 1 in which the whole crude oil feedstream is subjected to a topping process prior to mixing with the one or more extractive solvents to produce a first hydrocarbon stream of low sulfur content and a second whole crude oil stream of increased sulfur content.

11. The process of claim 1 which is conducted as a batch process.

12. The process of claim 1 which is conducted as a continuous process in a column.

13. The process of claim 1 which includes the further steps of treating the whole crude oil phase of reduced sulfur content recovered in step (c) to strip any retained solvent and recovering the stripped solvent for use in step (a).

14. The process of claim 1 in which the whole crude oil feedstream also includes non-aromatic sulfur-containing hydrocarbon compounds, and wherein the extractive solvents are selected to extract at least a portion of the aromatic sulfur-containing hydrocarbon compounds and at least a portion of the non-aromatic sulfur-containing hydrocarbon compounds from the whole crude oil feedstream.

* * * * *